US012097441B1

(12) United States Patent
Gregory

(10) Patent No.: US 12,097,441 B1
(45) Date of Patent: Sep. 24, 2024

(54) STRATEGIC BOUNCING GAME AND METHOD OF PLAYING SAME

(71) Applicant: Heath Gregory, Manhattan Beach, CA (US)

(72) Inventor: Heath Gregory, Manhattan Beach, CA (US)

( * ) Notice: Subject to any disclaimer, the term of this patent is extended or adjusted under 35 U.S.C. 154(b) by 0 days.

(21) Appl. No.: 18/606,996

(22) Filed: Mar. 15, 2024

(51) Int. Cl.
*A63F 9/00* (2006.01)

(52) U.S. Cl.
CPC ..... *A63F 9/001* (2013.01); *A63F 2009/0015* (2013.01)

(58) Field of Classification Search
CPC ..... A63F 9/001; A63F 2009/0015
See application file for complete search history.

(56) References Cited

U.S. PATENT DOCUMENTS

| | | | | |
|---|---|---|---|---|
| 6,612,577 | B1 * | 9/2003 | Tiffin | A63F 9/0415 273/288 |
| 11,766,606 | B1 * | 9/2023 | Brattesani | A63B 67/06 273/342 |
| 2011/0224034 | A1 * | 9/2011 | Rastegar | A63B 43/04 473/569 |
| 2011/0256967 | A1 * | 10/2011 | Shore | A63H 33/18 473/595 |

OTHER PUBLICATIONS

Corklink; "Agglomerated or natural corks" published at https://www.corklink.com/index.php/agglomeratdor-natural-corks/ (Year: 2014).*

Misty; Misty Mountain Meadworks video titled "This is our favorite drinking game. Cork bouncing into the tip jar"; published Oct. 10, 2020 at https://www.facebook.com/mistymountainmead/videos/this-is-our-favorite-drinking-game-cork-bouncing-into-the-tip-jar/931490940711543/ (Year: 2020).*

Smullen; "Quarters Drinking Game: Ignite the Fun at Your Party Tonight!"; published May 24, 2023 at https://beerismylife.com/drinking-games/quarters-drinking-game/ (Year: 2023).*

Farm; Farmtotabletosoul article titled "Wine Cork Guessing Game" published Sep. 11, 18 at https://farmtotabletosoul.com/2018/09/11/wine-cork-guessing-game/ (Year: 2018).*

* cited by examiner

*Primary Examiner* — Michael D Dennis
(74) *Attorney, Agent, or Firm* — Concourse Law Group; Katherine B. Sales, Esq.

(57) ABSTRACT

A game system comprising a container having a removable cap, and one or more cylindrical shaped game pieces contained within the container. A method of playing a bouncing game for one or more players, the method comprising the steps of: a) designating one of the one or more players as a Cork Master; b) providing each player with one cork; c) the Cork Master saying "Corks Up" and each player holding their corks in a horizontal position above a playing surface; d) the Cork Master saying "Go" and each player dropping their cork, attempting to bounce their cork and stand it up by landing on one its flat ends. When one or more players' corks stand up the one or more players hold up both hands and say "Done". Step d) is repeated until the last player has their cork stand up and the last player is then eliminated.

18 Claims, 8 Drawing Sheets

STRATEGIC BOUNCING GAME AND METHOD OF PLAYING SAME

BACKGROUND

A number of different types of competitive toss, throw and/or bouncing games have been described and played over the years. Game pieces of numerous shapes and sizes, including balls, horseshoes, bean bags, or weighted objects tied at the end of a short cord, have been tossed or thrown at various 'targets.'

However, all of those games require a 'target' of some kind, which is one more piece of the game that can get lost or misplaced. Moreover, most of those games cannot be played indoors in a convenient location.

Accordingly, there is a need for game that requires speed and skill and does not require extra 'target' pieces and is easy to play indoors and carry from place to place.

SUMMARY

The present invention addresses this need. In a first embodiment, the present invention is directed to a game system. The game system comprises a bottle-shaped container having an open top and closed bottom and forming a hollow cavity, a cap removably coupled to the open top, and one or more cylindrical shaped game pieces contained within the cavity in the container, each game piece having a curved side surface and two opposed flat end surfaces.

Optionally, there are eight game pieces and two of the game pieces are made from natural cork, two of the game pieces are made from agglomerated cork, two of the game pieces are made from micro-agglomerated cork, and two of the game pieces have an agglomerated cork body and two opposed natural cork ends.

In a second embodiment, the present invention is directed to a method of playing a bouncing game for one or more players. The method comprises the steps of a) designating one of the one or more players as a first Cork Master; b) the Cork Master providing each player with one cork, each cork being cylindrical in shape, having two opposed flat ends and a curved side surface disposed therebetween; c) the Cork Master saying "Corks Up"; d) each player holding their corks in a horizontal position above a playing surface; e) the Cork Master saying "Go"; and f) each player dropping their cork, attempting to have their cork bounce and stand up by landing on one of its flat ends.

In a third embodiment, the present invention is directed to a method of playing a bouncing game for one or more players. The method comprises the steps of a) providing each player with one cork, each cork being cylindrical in shape, having two opposed flat ends and a curved side surface disposed therebetween; b) each player holding their cork in a horizontal position above a playing surface; and c) each player dropping their cork, attempting to bounce their cork and have it stand up by landing on one its flat ends, wherein steps b) and c) are repeated until a last player stands up their cork on one of the opposed ends, and the last player is eliminated.

Optionally, steps b) through d) are repeated for one or more rounds.

Optionally, a winner is determined between the final two players with the first to win two rounds first.

Optionally, the winner is designated as the new Cork Master.

Optionally, if two or more players have their corks stand up at the same time, a one-on-one round is initiated to determine which of the two or more players will be eliminated.

Optionally, each cork has color on one end, which can add an additional difficulty. The player has to get the color side on top.

Optionally, the method further comprises step e) after step c), initiating a 30 second timer for 30 seconds of play time, wherein each player repeats steps c) and d) as many times as possible during the 30 seconds of play time.

Optionally, the player that stands their cork up the most times during the play time wins.

BRIEF DESCRIPTION OF THE DRAWINGS

These and other features, aspects, and advantages of the present invention will become better understood with regard to the following description, appended claims, and accompanying drawings.

DESCRIPTION

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Figure 1:
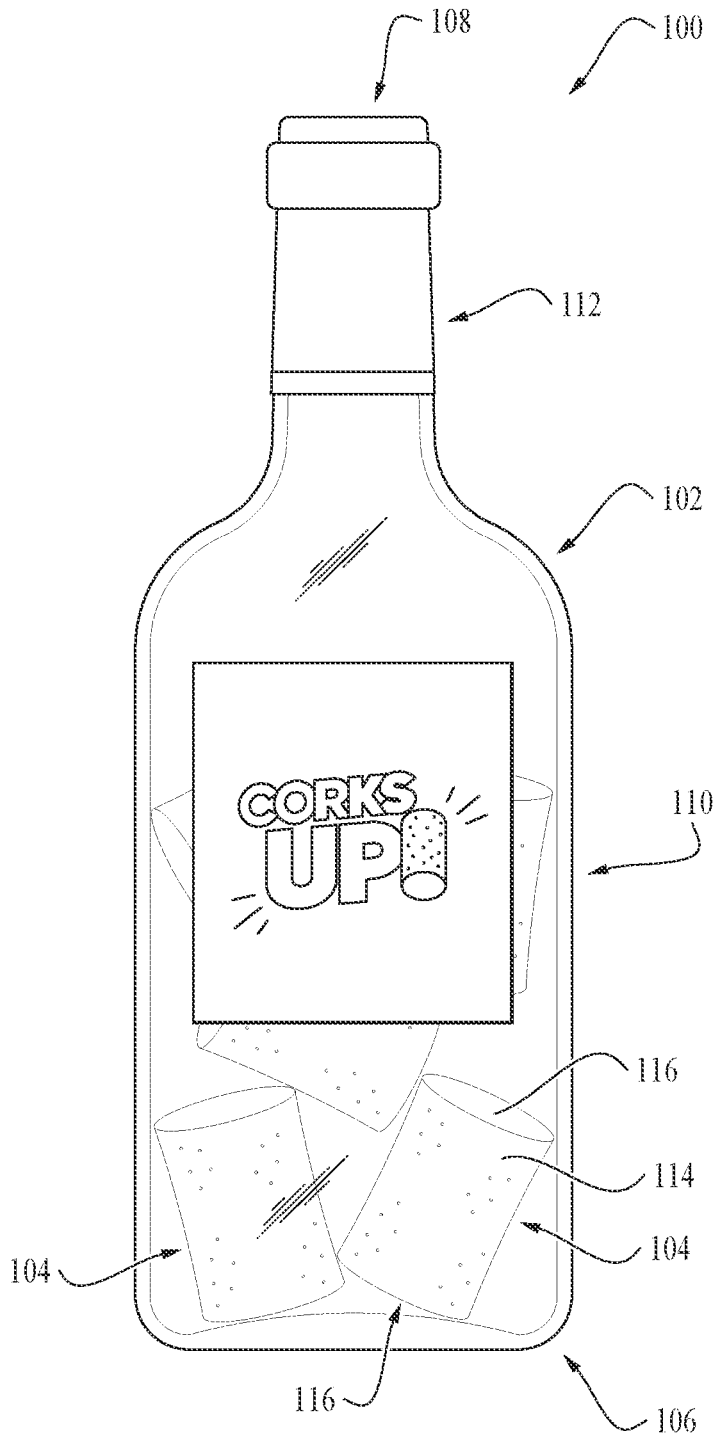
FIG. 1 is a front elevation view of a strategic bouncing game, having features of the present invention.

Referring now to FIG. 1, the invention is directed to a strategic bouncing game 100. The game 100 comprises a container 102 having one or more playing pieces 104 contained therein. The container 102 can be any shape that has a closed bottom 106 and an open top 108 that is preferably, but optionally, closeable with a removable cap. Preferably, the container 102 is bottle shaped, wherein a lower portion 110 of the container is cylindrical and has an interior diameter that is larger than an interior diameter of an upper portion 112. And more preferably, the upper portion 112 forms the "neck" of the bottle shaped container 102.

Each playing piece 104 is cylindrical, with a curved outer side surface 114 and two opposed, flat, circular end surfaces 116. However, each playing piece 104 can also be any shape as long as a body portion of the piece 104 has two opposed end surfaces that are flat.

The container 102 and the playing pieces 104 may be manufactured out of a variety of materials, including but not limited to cork, wood, rubber, rubber and cork composite materials, metal, other composite material, carbon fiber material, or plastic. Preferably, the container 102 is made from plastic and the playing pieces 104 are made from natural cork or other material that is deformable and can bounce when dropped on a hard surface.

More preferably, there are at least eight (8) playing pieces 104 in the container 102. And more preferably, two of the pieces 104 are made from natural cork, two of the pieces 104 are made from agglomerated cork, two of the pieces 104 are made from micro-agglomerated cork, and two of the pieces 104 are made from a combination of materials and have a central body portion of agglomerated cork and a disc of natural cork at each opposed end 116 so that the flat end surfaces 116 are made from natural cork. This is typically referred to as twin top cork. This variety of materials is desirable because then all of the pieces 104 react and behave differently when dropped. While eight pieces 104 (four pairs of two pieces 104) are described in detail, any combination of the above types of material, etc. can be used to make the pieces 104, and more or less than eight pieces 104 may be included in the container 102.

Figure 2:
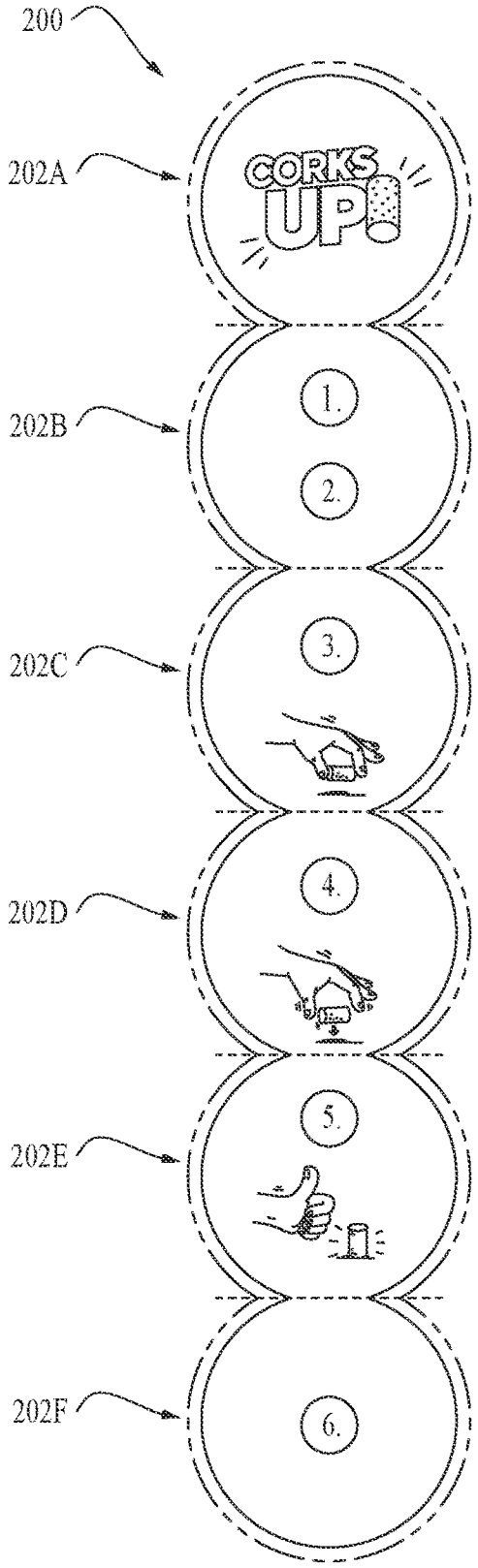
FIG. 2 is top plan view of a front side of instructions included with the bouncing game of FIG. 1.
Figure 3:
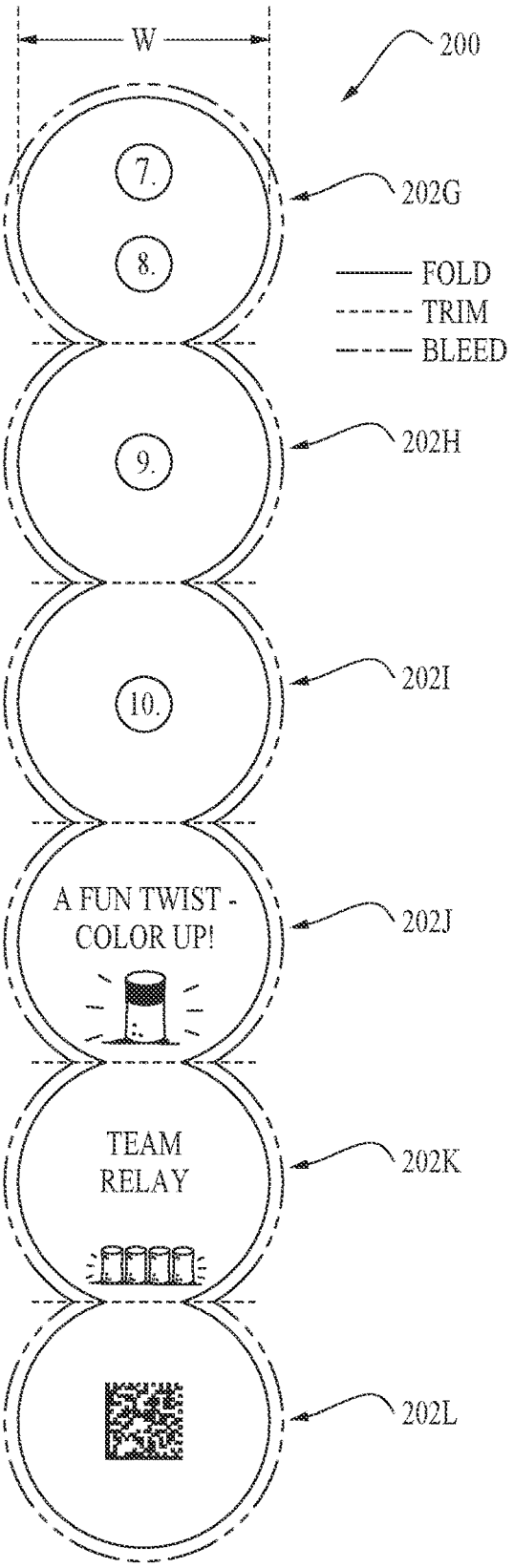
FIG. 3 is a top plan view of a rear side of the instructions of FIG. 2.

Referring now to FIGS. 2 and 3, there is shown a set of instructions 200 that comprise a plurality of circular sheets/panels 202 that are foldably connected to each other, and the instructions 200 have a front surface shown in FIG. 2 and a rear surface shown in FIG. 3. The set of instructions 200 recite and depict a step by step first method of playing the game 100. The sheets/panels 202 are not limited to the circular shape shown and can be in the shape of a square, rectangle, triangle, oval, or any other shape that would work for said purpose.

Referring specifically to FIG. 2, the front surface of a first panel 202A depicts the name and logo of the game 100. The front surface of a second panel 202B provides a description of a first step (1.) and a second step (2.) in playing the game 100. The front surface of a third panel 202C provides a description of a third step (3.) in playing the game 100. The front surface of a fourth panel 202D provides a description of a fourth step (4.) in playing the game 100. The front surface of a fifth panel 202E provides a description of a fifth step (5.) in playing the game 100. The front surface of a sixth panel 202F provides a description of a sixth step (6.) in playing the game 100.

Referring specifically to FIG. 3, the rear surface of the first panel 202G provides a description of a seventh step (7.) and an eighth step (8.) in playing the game 100. The rear surface of the second panel 202H provides a description of a ninth step (9.) in playing the game 100. The rear surface of the third panel 202I provides a description of a tenth step (10.) in playing the game 100. The rear surface of the fourth panel 202J provides a description of a second method of playing the game 100. The rear surface of the fifth panel 202K provides a description of a third method of playing the game 100. The rear surface of the sixth panel 202L provides contact information and a QR code.

Figure 5:
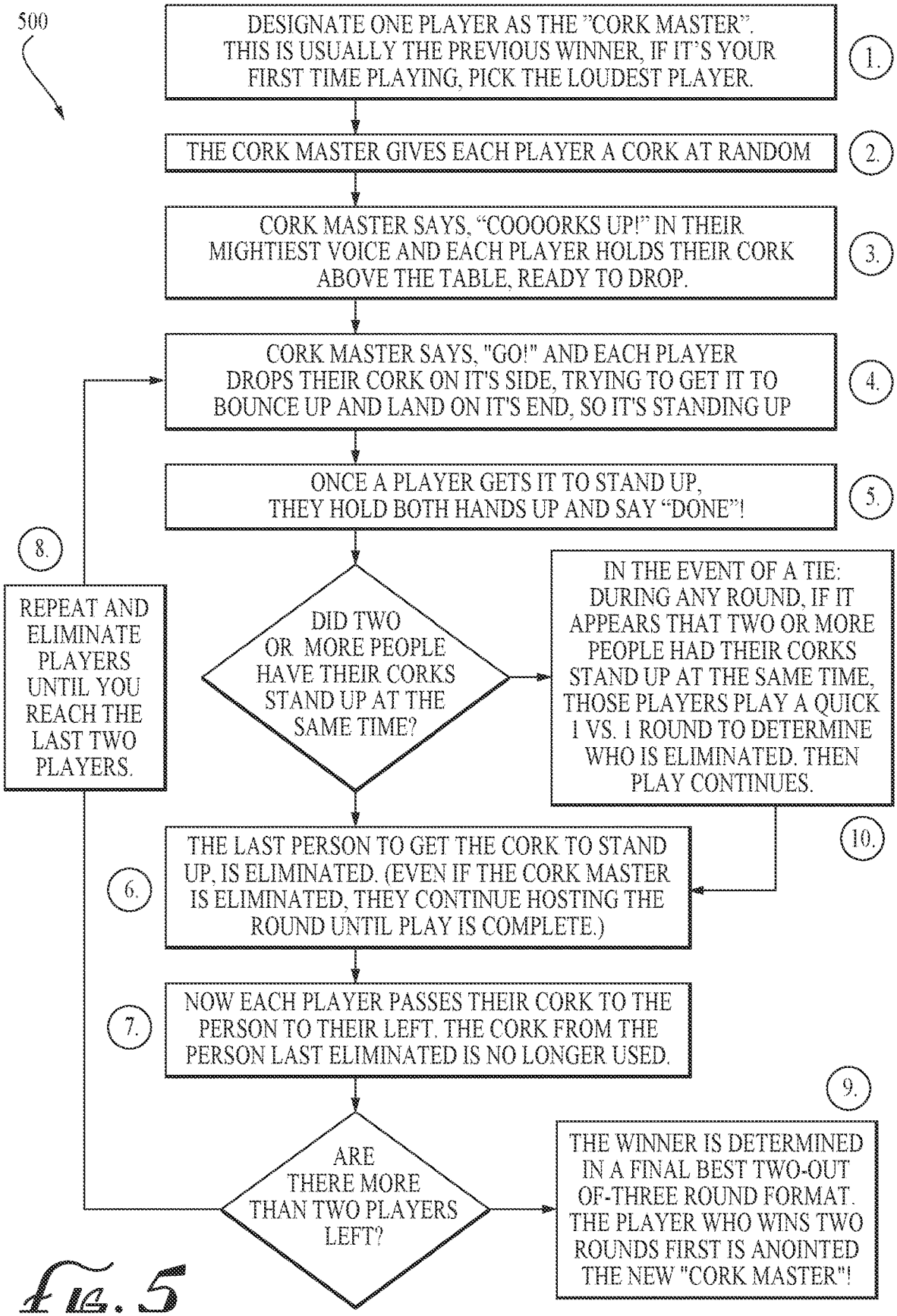
FIG. 5 is a flow chart of a first method of playing the bouncing game of FIG. 1.

Referring now to FIG. 5, there is shown a flow chart of the first method 500 of playing the game 100, which is recited/depicted on the second through ninth panels 202B-202I of the instructions 200. The first method 500 is entitled "Elimination."

The first step (1.) of the first method 500 of playing the game 100 is designating one player as the "Cork Master" for a first round of the game 100. The "Cork Master" is the "leader" and is not limited to being called the Cork Master, other titles can be used. The leader/Cork Master is usually the previous winner, however, if it is the first time playing the game 100, the loudest player is designated as the "Cork Master."

The second step (2.) is the Cork Master provides each player with a cork 104, selected at random.

Figure 4A:
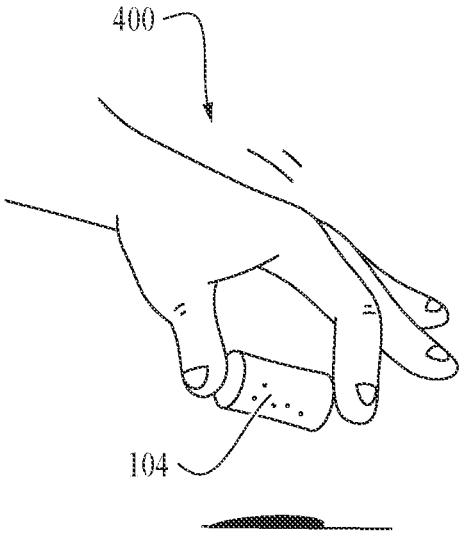
FIG. 4A is an enlarged view of a third step of playing the bouncing game of FIG. 1.

The third step (3.) is the Cork Master says "Corks Up!" and each player holds their cork 104 in a horizontal position above playing surface (typically a table or bar top however other playing surfaces can be used), ready to drop. FIG. 4A provides an enlarged view of the third step 400.

Figure 4B:
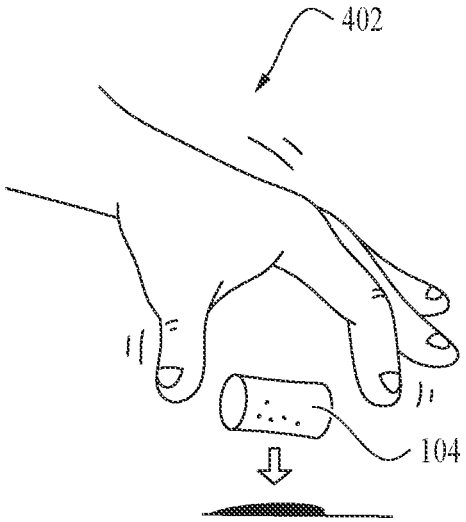
FIG. 4B is an enlarged view of a fourth step of playing the bouncing game of FIG. 1.
Figure 4C:
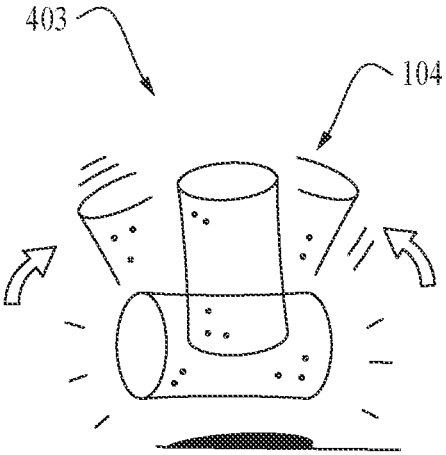
FIGS. 4C and 4D are enlarged views of a fifth step of playing the bouncing game of FIG. 1.

The fourth step (4.) is the Cork Master says "Go!" or "Drop" or some other term to indicate that the players can drop their corks 104, and each player then drops their cork 104 on its side 114, trying to get the cork 104 to bounce up and land on one of its opposed, flat ends 116. When the cork 104 lands on one of its opposed, flat ends, the cork 104 is "standing up." FIGS. 4B and 4C provide enlarged views of step four (4.) of dropping the cork 402 and having the cork 104 bounce 403.

Figure 4D:
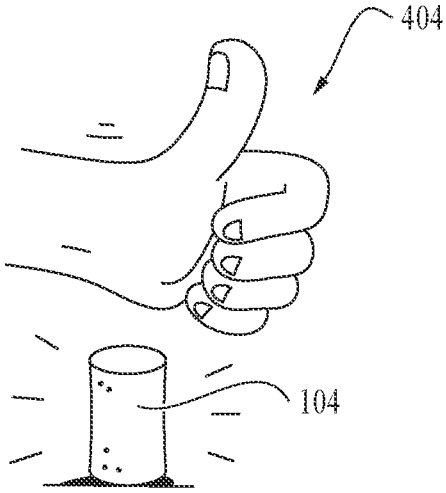

The fifth step (5.) is once a player gets the cork 104 to stand up, they say "Done", while optionally holding both of their hands up in the air. FIG. 4D provides an enlarged view of the fifth step 404.

The sixth step (6.) is the last person to get their cork 104 to stand up is eliminated. Even if the Cork Master is eliminated, the Cork Master continues hosting the round until play is complete.

The seventh step (7.) is, once the round is complete, each player passes their cork 104 to the player to their left (optionally, each player can pass their cork 104 to the player to their right). The cork 104 from the player last eliminated is no longer used.

The eighth step (8.) is repeat steps three (3.) through seven (7.) and continue to eliminate players until only two players remain.

The ninth step (9.) is determining the winner between the last two remaining players. This step is in the form of a final best two out of three round, where the player who wins two rounds first is anointed the new "Cork Master."

The tenth step (10.) is determining which player is eliminated in the event of a tie. During any round, if it appears that two or more players have their corks 104 stand up at the same time, those players play a one versus one round to determine who is eliminated. Then play continues.

Figure 6:
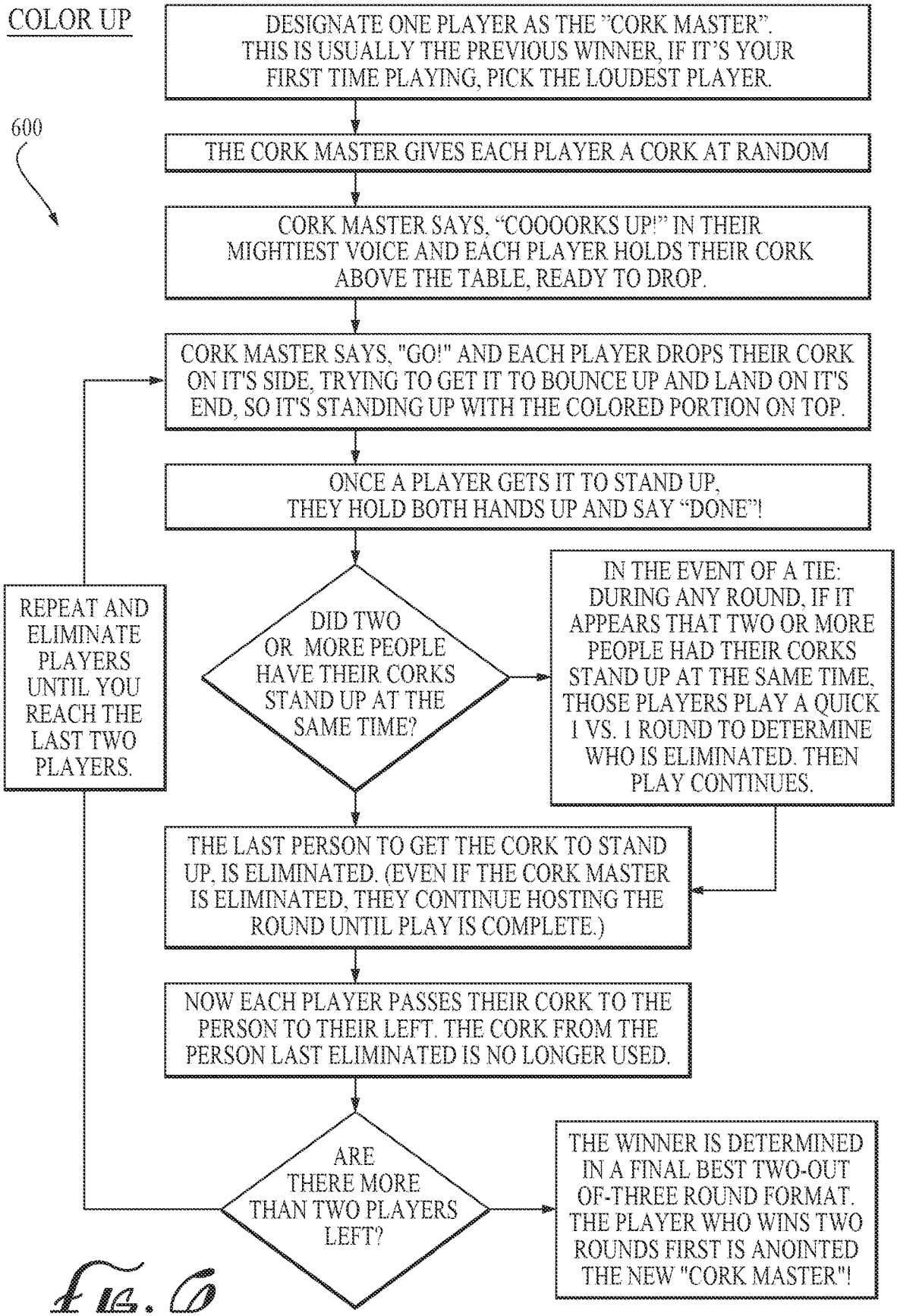
FIG. 6 is a flow chart of a second method of playing the bouncing game of FIG. 1.

Referring now to FIG. 6, there is shown a flow chart of the second method 600 of playing the game 100. The second method 600 is entitled "Color Up" and comprises the step of adding color to one end of each cork 104 prior to game play being initiated. Steps one (1.) through ten (10.) of the first method 500 recited above are then performed, except that step five (5.) requires the colored end of the cork 104 to land on top in order for a player to be able to say "Done."

Figure 7:
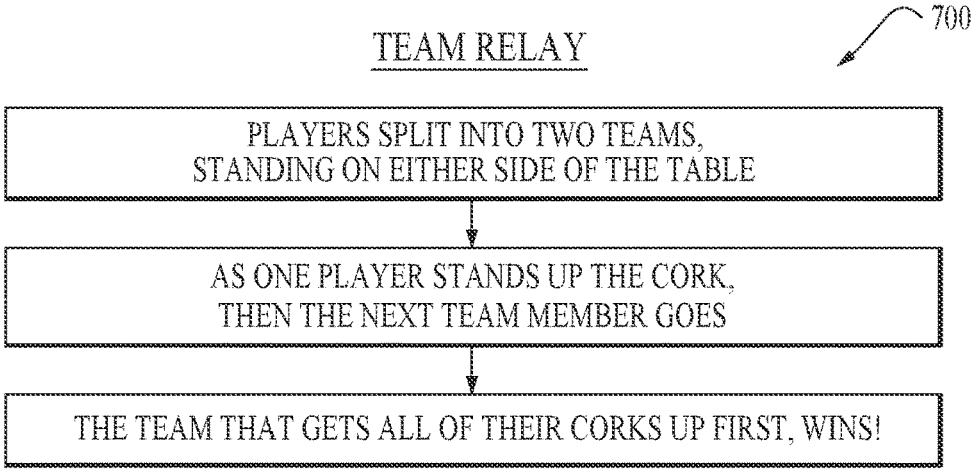
FIG. 7 is a flow chart of a third method of playing the bouncing game of FIG. 1.

Referring now to FIG. 7, there is shown a flow chart of the third method 700 of playing the game 100. The third method 700 is entitled "Team Relay," and comprises the step of, prior to initiating game play, dividing all of the players into two or more teams that are typically spaced along either side of a table or other playing surface. Starting at one end of the table, a player from each team drops and attempts to bounce and stand up their cork 104. Once one player stands up their cork 104, the next team member/player then starts their turn and begins dropping, bouncing and standing up the cork 104. The team that gets all of their corks 104 to stand up first, wins. A diagram of the lined up, standing up playing pieces 104 is provided in FIG. 3.

Figure 8:
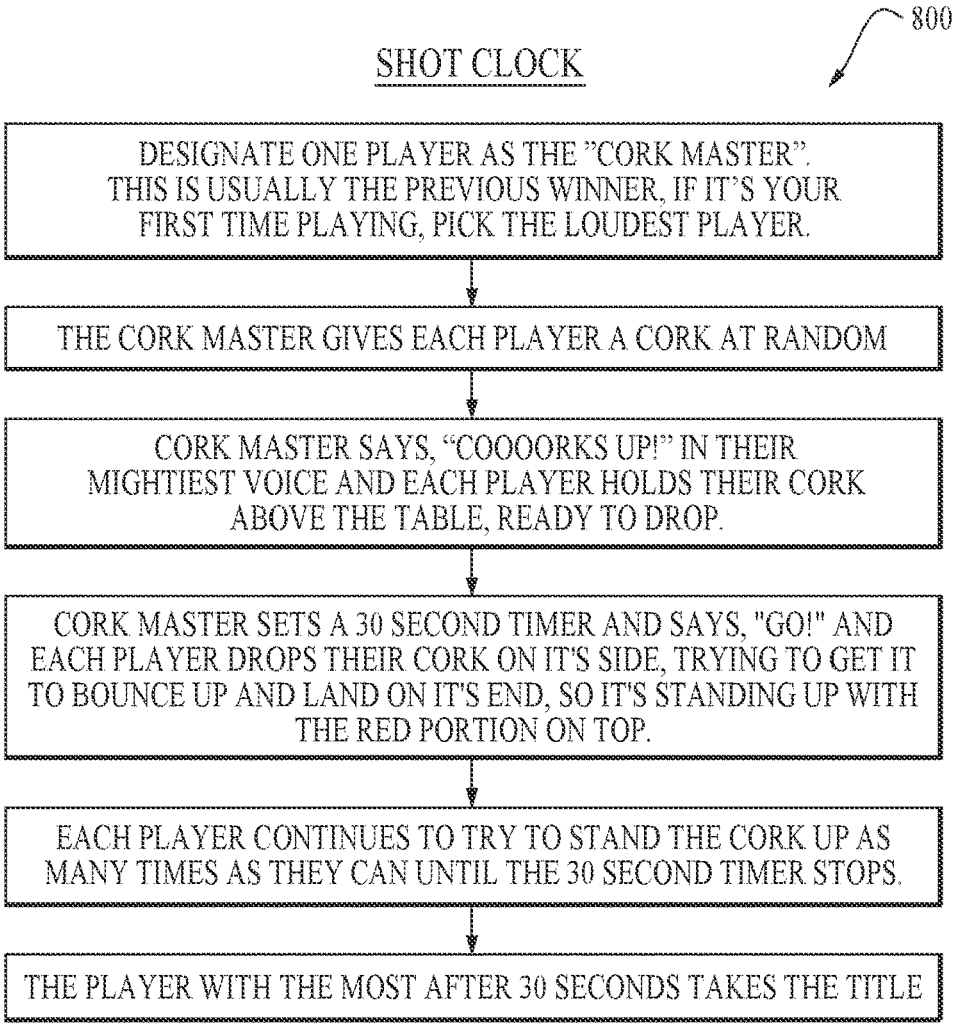
FIG. 8 is a flow chart of a fourth method of playing the bouncing game of FIG. 1.

Referring now to FIG. 8, there is shown a flow chart of a fourth method 800 of playing the game 100. The fourth method 800 is entitled "Shot Clock," and comprises the steps of the Cork Master setting a thirty (30) second timer and saying "go," at which time each player then drops their cork 104 on its side, trying to get it to bounce and stand up (steps three through five recited above). Each player repeats these steps and continues to try and stand up their cork 104 as many times as they can until the timer stops. The player with the most completed "stand ups" in the timed time period wins. This fourth method 800 can also incorporate the addition of the colored cork ends noted in the second method 600. It should be noted that this method 800 is not limited to use with a 30-second timer, and any amount of time can be used.

Figure 9:
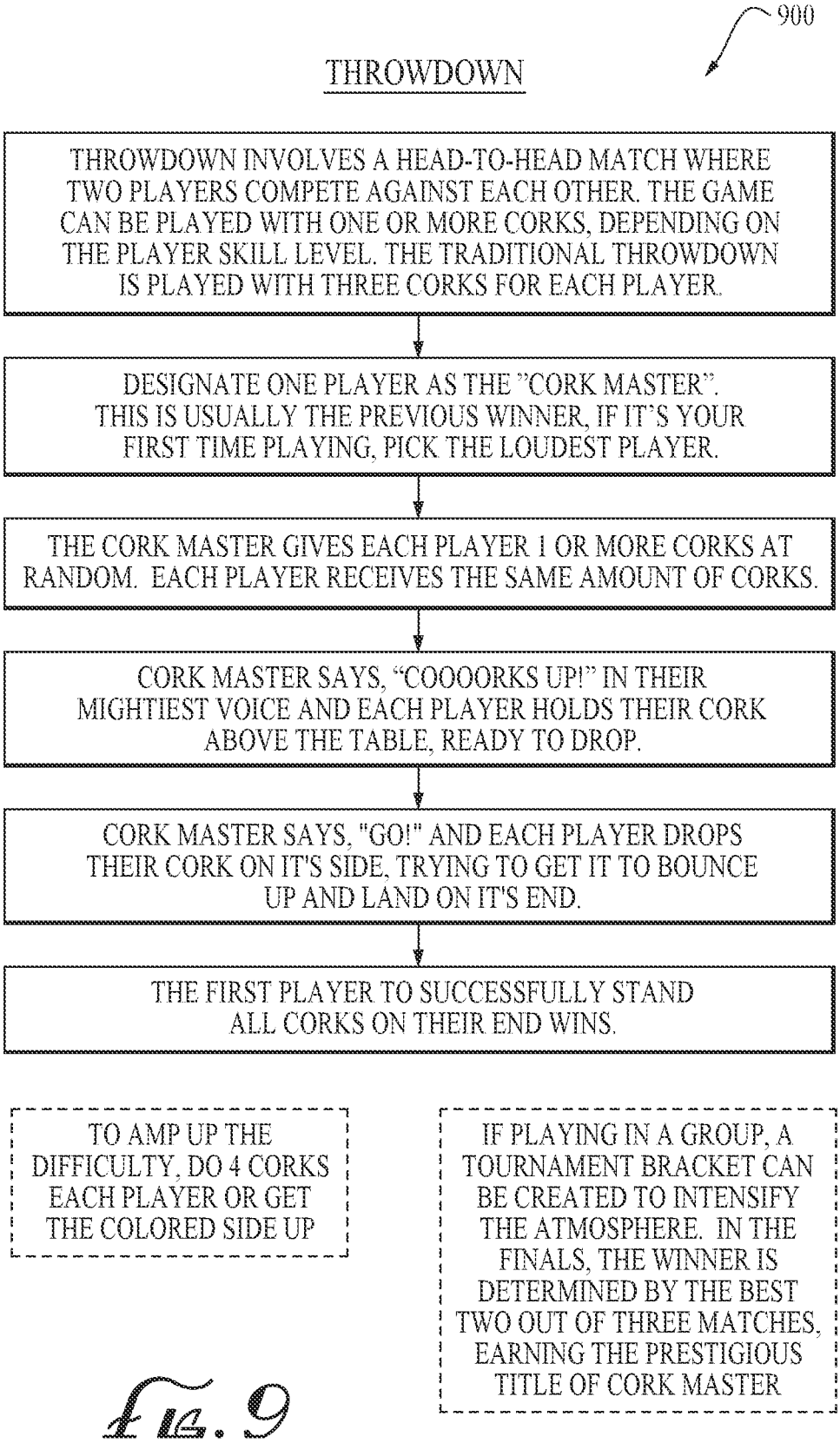
FIG. 9 is a flow chart of a fifth method of playing the bouncing game of FIG. 1.

Referring now to FIG. 9, there is shown a flow chart of a fifth method 900 of playing the game 100. The fifth method 900 is entitled "Throwdown" and comprises the steps of a) designating a Cork Master, b) the Cork Master providing each player with two or more corks, c) the Cork Master saying "Corks Up!" and each player holding their cork 104 in a horizontal position above playing surface, d) the Cork Master saying, "Go!" and each player drops their cork 104 on its side 114, trying to get the cork 104 to bounce up and land on one of its opposed, flat ends 116, so that the cork 104 is standing up. The first player to successfully stand up all their corks 104 wins. Additionally, the step of adding color of the second method 600 can be incorporated in this method 900 to increase difficulty.

Figure 10:
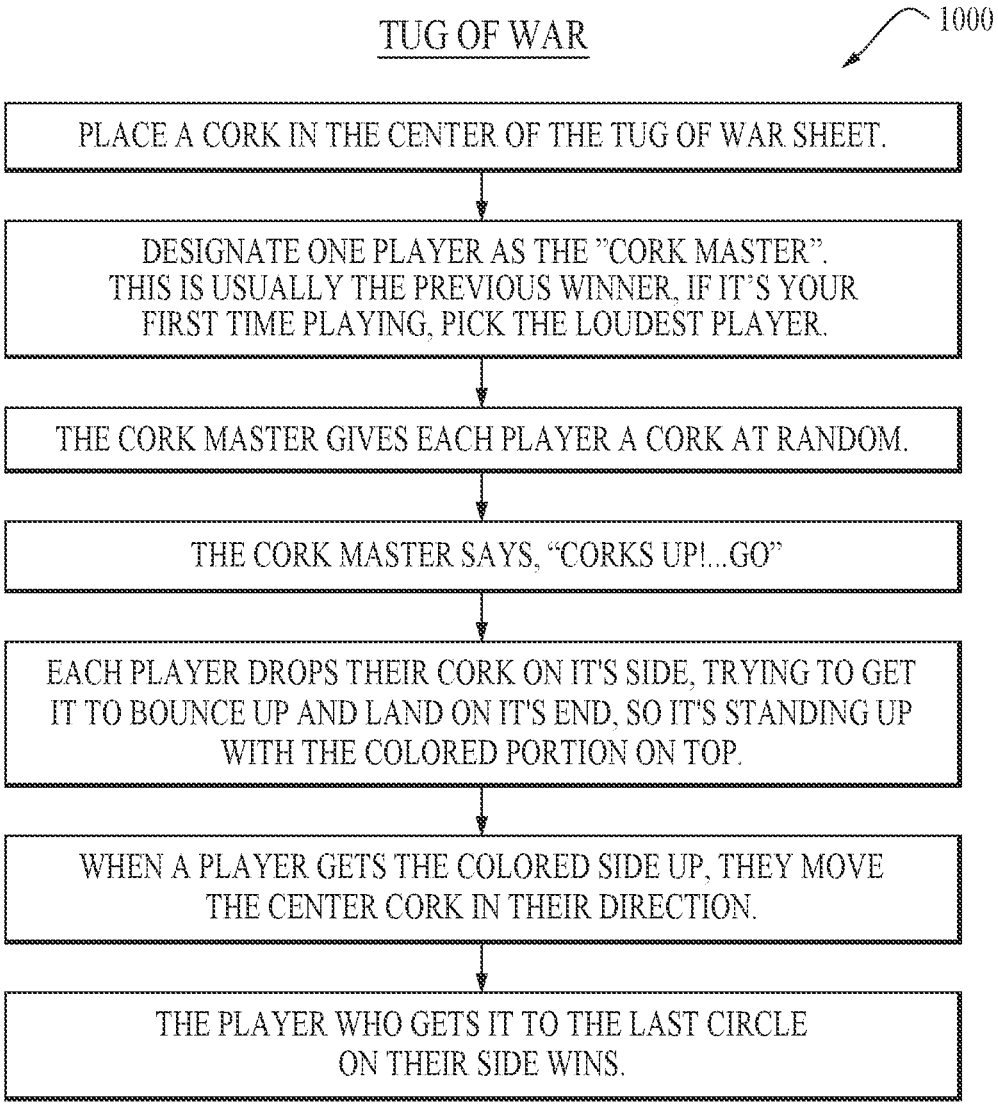
FIG. 10 is a flow chart of a sixth method of playing the bouncing game of FIG. 1.

Referring now to FIG. 10, there is shown a flow chart of a sixth method 1000 of playing the game 100. The sixth method 1000 is entitled "Tug of War," and utilizes a game board/sheet 1111 shown in FIG. 11. The game board/sheet 1111 can also be referred to as a tug of war sheet. The sheet/game board 1111 has a plurality of circles 1112 printed on the sheet 1111, wherein the circles 1112 are aligned in a line along the sheet 1111.

Figure 11:
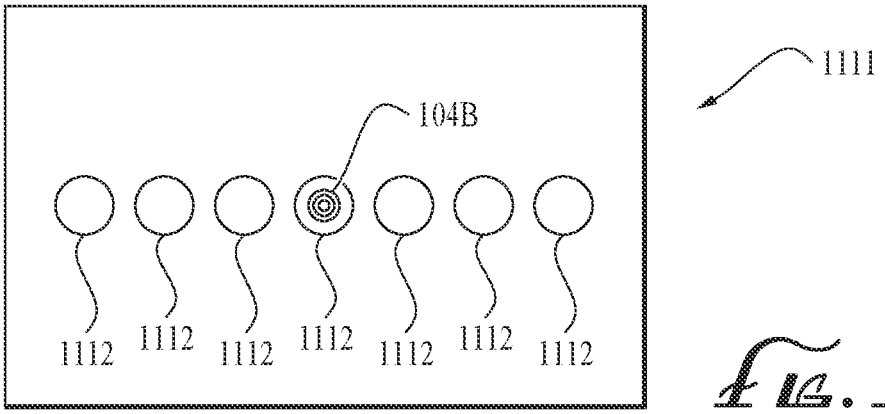
FIG. 11 is a diagram of a game board sheet used in the sixth method of FIG. 10.

The sixth method 1000 comprises the steps of a) placing a first cork 104A in the center-most circle 1112 of the tug of war sheet 1111 (this is shown in FIG. 11), b) designating a Cork Master, c) the Cork Master providing each player with one second cork 104B, each second cork 104B having a colored end, d) the Cork Master saying "Corks Up!" and each player holding their second cork 104B in a horizontal position above playing surface, and e) the Cork Master saying, "Go!" and each player dropping their cork 104B on its side 114, trying to get their cork 104B to bounce up and land with its colored end up. When a player gets their second cork 104B to bounce and land with its colored end up, that player moves the first cork 104A one circle 1112 towards that player, proximate that player. Steps d) and e) are repeated until a player moves the first cork 104A into the last circle 1112 closest to that player.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. A game system comprising:

a) a bottle-shaped container having an open top and closed bottom and forming a hollow cavity;

b) a cap removably coupled to the open top; and c) eight cylindrical shaped game pieces contained within the cavity in the container, each game piece having a curved side surface and two opposed flat end surfaces, wherein two of the game pieces are made from natural cork, two of the game pieces are made from agglomerated cork, two of the game pieces are made from micro-agglomerated cork, and two of the game pieces have an agglomerated cork body and two opposed natural cork ends.

2. The system of claim 1, wherein the game system is a cork bouncing and balancing game system.

3. A method of playing a bouncing game for one or more players using the system of claim 1, the method comprising the steps of: a) designating one of the one or more players as a first Cork Master; b) the Cork Master providing each player with one cork; c) the Cork Master saying "Corks Up"; d) each player holding their corks in a horizontal position above a playing surface; e) the Cork Master saying "Go"; and f) each player dropping their cork, attempting to have their cork bounce and stand up by landing on one its flat ends, wherein when one or more players' corks stand up the one or more players hold up both hands and say "Done"; wherein steps d) and f) are repeated until the last player has their cork stand up, and the last player is then eliminated.

4. The method of claim 3, wherein steps b) through d) are repeated for one or more rounds.

5. The method of claim 4, wherein a winner is determined by winning two rounds first.

6. The method of claim 5, wherein the winner is designated a second Cork Master.

7. The method of claim 3, wherein if two or more players had their corks stand up at the same time, a one-on-one round is initiated to determine which of the two or more players will be eliminated.

8. The method of claim 3, wherein each cork has color on one end.

9. The method of claim 3, further comprising step e) after step c) initiating a 30 second timer for 30 seconds of play time, wherein each player repeats steps c) and d) as many times as possible during the 30 seconds of play time.

10. The method of claim 9, wherein the player stands their cork up the most times during the play time wins.

11. A method of playing a bouncing game for one or more players using the system of claim 1, the method comprising the steps of: a) providing each player with one cork; b) each player holding their cork in a horizontal position above a playing surface; c) each player dropping their cork, attempting to have their cork bounce and stand up by landing on one its flat ends; wherein step c) is repeated until a last player stands up their cork on one of the opposed ends, and the last player is eliminated.

12. The method of claim 11, wherein steps b) and c) are repeated for one or more rounds until two players remain.

13. The method of claim 12, wherein a winner of the two players remaining is determined by the two players remaining engaging in at least two final, one on one rounds, wherein one of the two player remaining wins two rounds first.

14. The method of claim 13, wherein the winner is designated a second Cork Master.

15. The method of claim 12, wherein if two or more players have their corks stand up at the same time, a one-on-one round is initiated to determine which of the two or more players will be eliminated.

16. The method of claim 11, wherein each cork has color on one end.

17. The method of claim 11, further comprising step d) after step a) initiating a 30 second timer for 30 seconds of play time, wherein each player repeats steps b) and c) as many times as possible during the 30 seconds of play time.

18. The method of claim 17, wherein the player stands their cork up the most times during the play time wins.

* * * * *